US008083830B2

(12) United States Patent
Tanaka et al.

(10) Patent No.: US 8,083,830 B2
(45) Date of Patent: Dec. 27, 2011

(54) SLAG FOR ELECTROSLAG REMELTING FOR COPPER ALLOY AND METHOD FOR PRODUCING COPPER ALLOY MATERIAL

(75) Inventors: Shinji Tanaka, Hokkaido (JP); Mamoru Mizusawa, Hokkaido (JP); Hitohisa Yamada, Hokkaido (JP)

(73) Assignee: The Japan Steel Works Ltd., Tokyo (JP)

( * ) Notice: Subject to any disclaimer, the term of this patent is extended or adjusted under 35 U.S.C. 154(b) by 13 days.

(21) Appl. No.: 12/809,313

(22) PCT Filed: Dec. 18, 2008

(86) PCT No.: PCT/JP2008/073108

§ 371 (c)(1),
(2), (4) Date: Jun. 18, 2010

(87) PCT Pub. No.: WO2009/078467

PCT Pub. Date: Jun. 25, 2009

(65) Prior Publication Data

US 2010/0269633 A1 Oct. 28, 2010

(30) Foreign Application Priority Data

Dec. 18, 2007 (JP) ..... 2007-326097

(51) Int. Cl.
*C22B 9/10* (2006.01)
*C22B 9/18* (2006.01)

(52) U.S. Cl. ..... 75/10.25; 75/306; 75/309; 75/329; 75/652

(58) Field of Classification Search ..... 75/306, 75/309, 329, 10.25, 652; 420/520
See application file for complete search history.

(56) References Cited

U.S. PATENT DOCUMENTS 4,619,692 A * 10/1986 Jachowski et al. ..... 75/10.25

FOREIGN PATENT DOCUMENTS

| | | | | |
|---|---|---|---|---|
| JP | 53048926 | A | | 5/1978 |
| JP | 57209795 | A | | 12/1982 |
| JP | 61183419 | A | | 8/1986 |
| JP | 03138323 | A | * | 6/1991 |
| JP | 3138323 | A | | 6/1991 |
| JP | 5318087 | A | | 12/1993 |
| JP | 2000218393 | A | * | 8/2000 |

OTHER PUBLICATIONS

Derwent Acc-No. 2003-078799 for patent family inlcuding 2002-239784 A published Aug. 28, 2002. Abstract.*
International Search Report (PCT/ISA/210) dated Feb. 10, 2009, issued in PCT/JP2008/073108.
English Translation of Written Opinion (PCT/ISA/237) issued in PCT/JP2008/073108.

* cited by examiner

*Primary Examiner* — George Wyszomierski
*Assistant Examiner* — Tima M McGuthry Banks
(74) *Attorney, Agent, or Firm* — Sughrue Mion, PLLC

(57) ABSTRACT

An object of the invention is to make it possible to produce a copper alloy in which the S content is reduced with no contamination with Al, which has a good casting surface and good internal properties and in which eutectic compounds are refined. The invention relates to a slag for electroslag remelting for copper alloy, including $CaF_2$: 20 to 45% by mass, CaO: 10 to 30% by mass, $SiO_2$: 10 to 30% by mass, LiF: 10 to 20% by mass, and $ZrO_2$: 5 to 15% by mass with other impurities: at most 1% by mass, and satisfying a formula:

$$17.0(\text{LiF content}+ZrO_2\text{ content})-556 \leqq CaF_2\text{ content} \leqq 4.1(\text{LiF content}+ZrO_2\text{ content})-80.9,$$

and the invention relates to a method for producing a copper alloy with the slag.

4 Claims, 9 Drawing Sheets

(a) (b)

(a) (b)

(a) (b)

SLAG FOR ELECTROSLAG REMELTING FOR COPPER ALLOY AND METHOD FOR PRODUCING COPPER ALLOY MATERIAL

TECHNICAL FIELD

The present invention relates to a slag for electroslag remelting for copper alloy favorable for use in production of a copper alloy which has a low S content with no contamination with Al and has a good casting surface and good internal properties and in which eutectic compounds are refined, and to a method for producing a copper alloy material with the slag.

BACKGROUND ART

Heretofore, as a method for producing an ingot required to have a high cleanliness, known is an electroslag remelting process (hereinafter this may be referred to as ESR process). The ESR process is a process for producing a clean ingot by melting an electrode by the resistance heat of a molten slag and then successively solidifying the melt in a water-cooling mold. In the ESR process, a slag having a suitable specific resistance, melting point and viscosity must be used, and in general, a $CaF_2$—CaO—$Al_2O_3$ ternary slag is used. However, the slag was developed for melting a Fe-base alloy or a Ni-base alloy and therefore has the property that its melting point is high.

On the other hand, a large-size ingot (1 ton or more) of a copper alloy is generally produced by melting according to a mold casting method or a continuous casting method. A copper alloy has a higher thermal conductivity than steel and may often have cast defects inside it as its solidification speed is high. A copper alloy produced by melting an inexpensive material such as scrap or the like often contains S in an amount of several tens ppm or more, and its intergranular strength lowers owing to S segregating in the grain boundary therein, and therefore its high temperature ductility greatly worsens. Further, certain copper alloys may have a large quantity of eutectic compounds formed therein during solidification, and when a large-size ingot of such a copper alloy is produced by melting according to a mold casting method, then the eutectic compounds may grow to coarse grains to worsen the workability of the alloy. In addition, the copper alloy of the type has a low strength at a high temperature, and therefore its ingot is difficult to draw in a continuous casting method.

Accordingly, investigations have been made regarding the applicability of the ESR process to a copper alloy; however, since a copper alloy has a low melting point, a slag having a high melting point as in the above could not be applied to melting by ESR for a copper alloy. In fact, there are known a few examples of melting by ESR for a copper alloy, and there are few reports relating to a slag for copper alloy; however, in some literatures such as Patent Literature 1 and Patent Literature 2, a slag for copper alloy is proposed.

In Patent Literature 1, proposed is an electroslag remelting method for copper and copper alloy, comprising simultaneously adding one or more of, by mass, $SiO_2$: 5 to 40%, $TiO_2$: at most 10%, $Na_2O$: at most 5%, MnO: at most 5%, BaO: at most 5%, and MgO: at most 10%, to a basic composition of $Na_3AlF_6$—$CaF_2$—$Al_2O_3$ or $CaF_2$—LiF—$Al_2O_3$.

In Patent Literature 2, proposed is an electroslag casting method for copper or copper alloy, comprising using a slag having a compositional ratio, by mass, of $SiO_2$: 30 to 40%, MnO: 9 to 15%, $Al_2O_3$: 1 to 8%, $TiO_2$: ≦10%, BaO: ≦1%, CaO: 15 to 80%, $CaF_2$: 3 to 7%, and MgO: ≦2%.

Patent Literature 1: JP-A-61-183419
Patent Literature 2: JP-A-53-48926

DISCLOSURE OF THE INVENTION

Problems that the Invention is to Solve

In a related ingot-making method, it is difficult to completely prevent cast defects from forming in a copper alloy, as described in the above. The copper alloy produced from an inexpensive melting material has a large S content, and its high temperature ductility is low. Further, in the copper alloy of the type with eutectic compounds forming therein, coarse eutectic compounds may form during solidification to further worsen the high temperature ductility of the alloy; however, S can be removed through slag-metal interaction therein.

The slag-metal desulfurization is represented by S+(CaO)=(CaS)+O. In this, the equilibrium constant is represented by $K_{CaS}=a_{CaS}\cdot a_O/a_S\cdot a_{CaO}$. $a_S$ and $a_O$ each mean the sulfur and oxygen activity, respectively, in the melt; $a_{CaS}$ and $a_{CaO}$ each mean the CaS and CaO activity, respectively, based on the pure solid state thereof. From the reaction formula, the desulfurization may go on more readily at a higher CaO concentration in the slag and at a lower oxygen content in the melt.

However, since CaO is not added to the slag described in Patent Literature 1, the desulfurization effect could not be expected in electroslag remelting therein. $Al_2O_3$ is added to the slag, and therefore, there is a high possibility that the copper alloy obtained through remelting may be contaminated with Al owing to the formation of a solid solution of Al and Cu therein. Even though in a small amount, Al may greatly lower the electroconductivity of the copper alloy, and therefore contamination with Al of the alloy must be evaded as much as possible so far as Al is not an alloying element.

The slag described in Patent Literature 2 contains the fluoride that promotes slag formation and lowers the melting point and the viscosity of the slag, only in an amount of at most 7%, and the targeted melting point of the slag is from 1300 to 1800° C. and is high. When the melting point and the viscosity of the slag are high, then it is expected that the solidified slag layer between the molten slag as well as the solidified ingot and the water-cooling mold, or that is, the slag skin therebetween may be thick during electroslag remelting, and therefore the casting surface may be roughened more. In addition, $Al_2O_3$ is also added to the slag, like in the slag proposed in Patent Literature 1, and therefore, there is a high possibility that the copper alloy obtained through remelting may be contaminated with Al.

The invention has been made for solving the prior-art problems as mentioned above, and aims to provide an ESR slag for a copper alloy which has a low S content with no contamination with Al and has a good casting surface and good internal properties and in which the eutectic compounds are refined, and a method for producing a copper alloy material.

Means for Solving the Problems

Specifically, the invention relates to the following [1] to [4]:

[1] A slag for electroslag remelting for copper alloy, including $CaF_2$: 20 to 45% by mass, CaO: 10 to 30% by mass, $SiO_2$: 10 to 30% by mass, LiF: 10 to 20% by mass, and $ZrO_2$: 5 to 15% by mass with other impurities: at most 1% by mass, and satisfying the following formula:

$$17.0(\text{LiF content}+ZrO_2\text{ content})-556 \leqq CaF_2\text{ content} \leqq 4.1(\text{LiF content}+ZrO_2\text{ content})-80.9.$$

[2] The slag for electroslag remelting for copper alloy as stated in the above [1], further including at least one of $Cr_2O_3$, MnO, $TiO_2$ and MgO: at most 5% by mass in total.

[3] The slag for electroslag remelting for copper alloy as stated in the above [1] of [2], wherein the slag has a specific resistance of from 0.1 to 0.7Ω·cm and a viscosity of at most 1 poise at 1000° C. or higher.

[4] A method for producing a copper alloy material by electroslag-melting a copper alloy with the slag for electroslag melting for copper alloy as stated in any one of the above [1] to [3].

Advantage of the Invention

As in the above, the slag for electroslag melting for Si-containing copper alloy of the invention contains $CaF_2$: 20 to 45% by mass, CaO: 10 to 30% by mass, $SiO_2$: 10 to 30% by mass, LiF: 10 to 20% by mass, and $ZrO_2$: 5 to 15% by mass with other impurities: at most 1% by mass, and satisfies a formula of 17.0 (LiF content+$ZrO_2$ content)−556≦$CaF_2$≦4.1 (LiF content+$ZrO_2$ content)−80.9; and using the slag, a copper alloy material can be obtained, in which S is reduced with no contamination with Al, which has a good casting surface and good internal properties, and in which the eutectic compounds are refined.

DESCRIPTION OF REFERENCE NUMERALS

Figure 1:
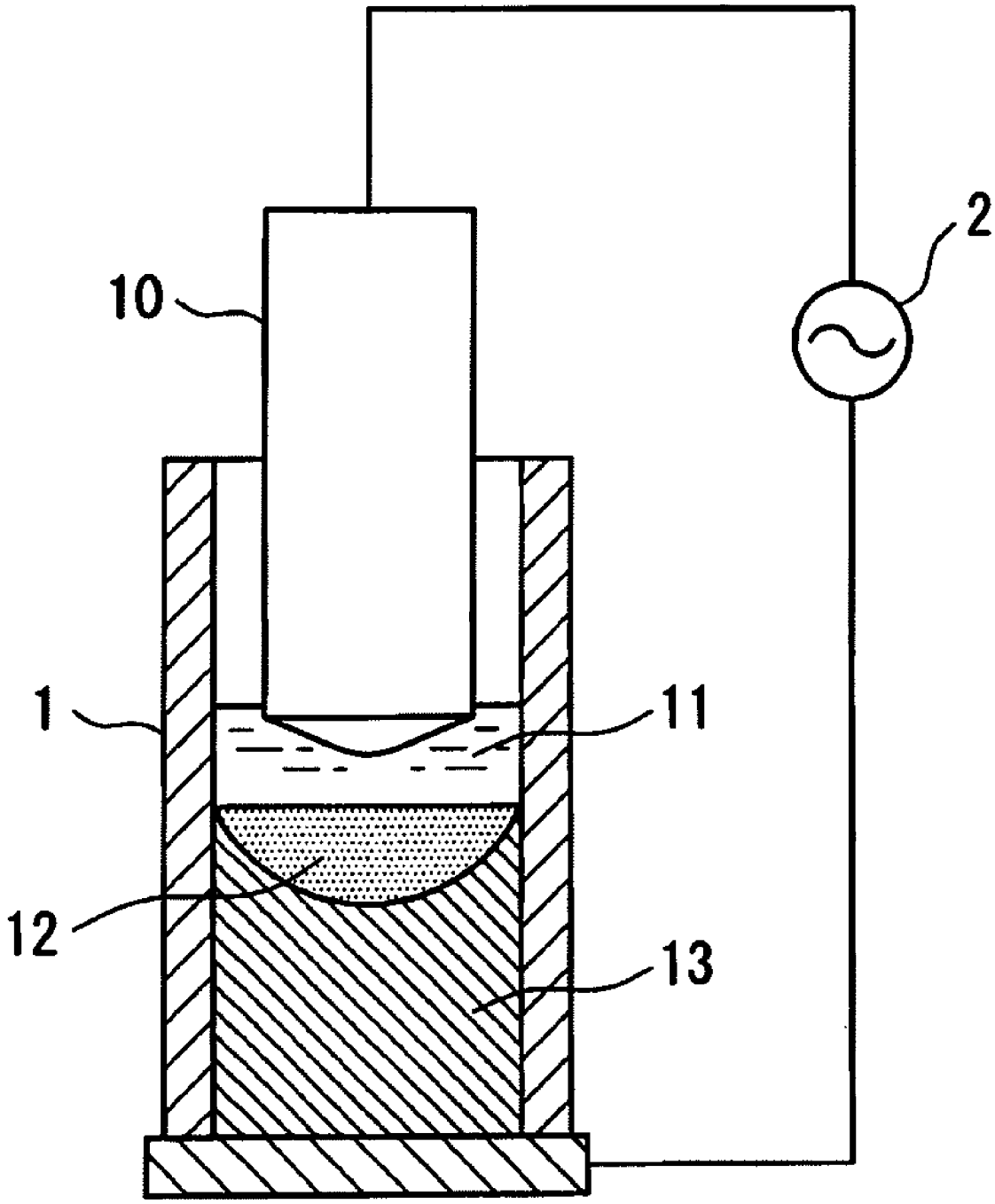
FIG. 1 A view for explaining electroslag remelting with a slag of one embodiment of the invention.

1 ESR Furnace
2 Power Source
10 ESR Electrode
11 Slag
12 Melt Pool
13 ESR Ingot

BEST MODE FOR CARRYING OUT THE INVENTION

One embodiment of the invention will be described below.

A slag of the invention contains CaO as added thereto for making it has a desulfurization ability, in which the content of $CaF_2$, CaO and $SiO_2$ is so controlled as to be targeted to a composition having a melting point as low as possible. Further, LiF is added thereto so as to control the melting point to be from 800 to 1000° C. It is judged that the melting point of slag is suitably from the melting point of electrode minus 100° C. to the melting point of electrode minus 200° C. from experience with a Fe-base alloy and an Ni-base alloy. The melting point of copper alloy is from 1000 to 1100° C. or so, and therefore the melting point of the slag is suitably from 800 to 1000° C. For preventing the ingot from being contaminated with Al, $Al_2O_3$ is not used but $ZrO_2$ is added. There is a high possibility of contamination of the ingot with Zr owing to $ZrO_2$ contained in the slag; however, a small amount of Zr does not have any significant influence on the properties of the ingot, and the contamination may be of no problem.

In case where the specific resistance of the slag is too high, the slag could not generate heat necessary for its melting; but on the contrary, when too low, the input power shall increase to thereby increase the melting cost. Accordingly, the specific resistance of the slag is controlled to be from 0.1 to 0.7Ω·cm within the operating temperature range of not lower than 1000° C. More preferably, the specific resistance is from 0.15 to 0.5Ω·cm. As a result of assiduous studies, we have ascertained that, when the slag viscosity is at most 1 poise at a temperature not lower than the melting point of the electrode, then stable melting is possible and an ingot having a good casting surface can be obtained. Accordingly, the invention slag is controlled to have a viscosity of at most 1 poise at 1000° C. or higher.

The invention slag is optimized in point of the melting point, the specific resistance and the viscosity thereof, and therefore, even when it is melted with an input power reduced as much as possible, a slag skin having a suitable thickness may be formed and stable melting may be possible. As a result of reducing the input power, not only the melting cost could be reduced but also the ingot partial solidification time could be shortened, therefore bringing about an effect of refining the forming eutectic compounds.

The effect of each component and the reason for defining the content thereof (hereinafter this is expressed in terms of % by mass) are described below.

$CaF_2$: 20 to 45%

$CaF_2$ is a basic component of the slag, and is added for adequately regulating the viscosity, the melting point and the specific resistance thereof. However, when its content is too large, then the specific resistance lowers; but on the contrary, when too small, the melting point rises and stable melting may be therefore difficult. Accordingly, the $CaF_2$ content is from 20 to 45%. Preferably, the lower limit is 20% and the upper limit is 28%.

CaO: 10 to 30%

CaO increases the basicity of the slag and improves the desulfurization ability thereof. For attaining this effect, it must be incorporated in an amount of at least 10%. On the other hand, a too high content may raise the viscosity and the melting point, and therefore, the CaO content is from 10 to 30%. Preferably, the lower limit is 20% and the upper limit is 28%.

$SiO_2$: 10 to 30%

$SiO_2$ is necessary for increasing the specific resistance. However, a too high content lowers the basicity and lowers the desulfurization ability. Accordingly, the $SiO_2$ content is from 10 to 30%. Preferably, the lower limit is 20% and the upper limit is 28%.

LiF: 10 to 20%

LiF must be in an amount of at least 10% for the purpose of lowering the melting point of the slag. However, a too high content lowers the specific resistance. Accordingly, the LiF content is from 10 to 20%. More preferably, the lower limit is 13% and the upper limit is 18%.

$ZrO_2$: 5 to 15%

$ZrO_2$ is necessary for increasing the specific resistance. However, when it is less than 5%, its effect could not be sufficiently attained; but when the content is too high, the melting point rises. Accordingly, the $ZrO_2$ content is from 5 to 15%. Preferably, the lower limit is 8% and the upper limit is 12%.

At Least One of $Cr_2O_3$, MnO, $TiO_2$ and MgO: at Most 5% in Total

At least one of $Cr_2O_3$, MnO, $TiO_2$ and MgO may be added for the purpose of stabilizing the yield of Cr, Mn, Ti and Mg, respectively, to be contained in the melting copper alloy. The content is in such a degree that does not significantly change the properties of the slag, and is at most 5% in total.

Other Impurities: at Most 1%

The other impurities are to be factors of alternating the characteristics of the slag, and their amount is at most 1% in total. The impurities include, for example, CaS, MnS, FeO, $Na_2O$, etc.

The composition of the slag of the invention satisfies the following formula:

$$17.0(\text{LiF content}+ZrO_2\text{ content})-556 \leqq CaF_2\text{ content} \leqq 4.1(\text{LiF content}+ZrO_2\text{ content})-80.9.$$

Figure 7:
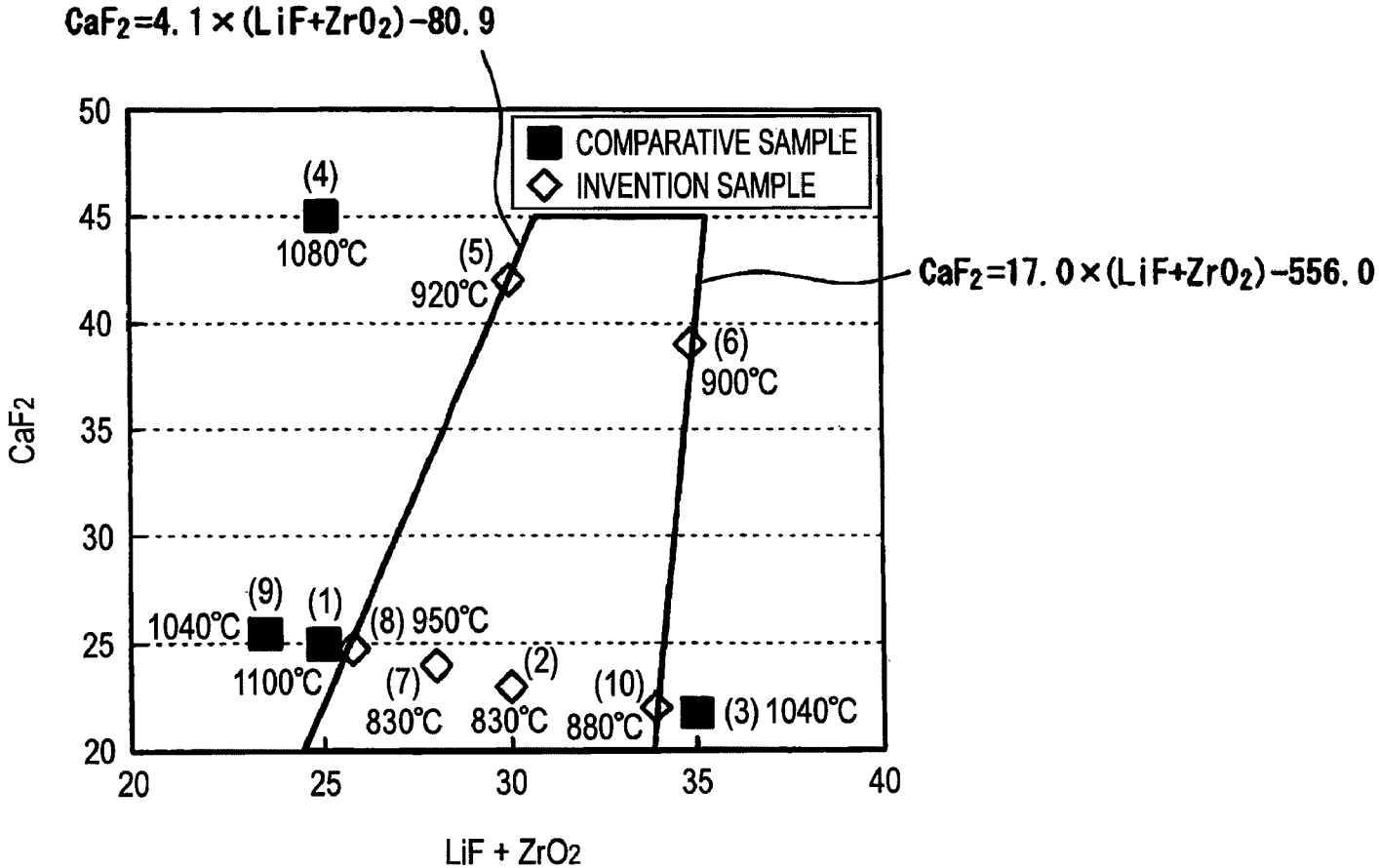
FIG. 7 A composition diagram where components in Example of the invention are plotted.

$CaF_2$, LiF and $ZrO_2$ have significant influences especially on the melting point; and plotting the relationship of the $CaF_2$ content, (LiF content+$ZrO_2$ content) and the melting point gives a graph of FIG. 7. From this, when $CaF_2$ is lower than 17.0(LiF content+$ZrO_2$ content)−556, and when $CaF_2$ is higher than 4.1(LiF content+$ZrO_2$ content)−80.9, then the melting point is high and the slag is difficult to apply to electroslag remelting. Accordingly, satisfying the above formula is indispensable.

FIG. 1 shows one embodiment of electroslag remelting with the slag of the invention.

An ESR electrode 10 is formed of a copper alloy of which the components are so controlled as to give an ingot having a desired composition, and this is set in the ESR furnace 1 movably up and down therein, and is connected to one terminal of the power source 2. In the invention, the composition of the copper alloy is not limited to a specific one, but the composition may be determined in accordance with the targeted composition of the desired ingot.

In the ESR furnace 1, the other terminal of the power source 2 is connected to the electroconductive hearth. Though not shown, a suitable cooling means such as a water-cooling unit may be provided around the wall of the ESR furnace 1.

In the ESR furnace 1, a slag 11 of the invention is charged, which is so formulated as to contain, by mass, $CaF_2$: 20 to 45%, CaO: 10 to 30%, $SiO_2$: 10 to 30%, LiF: 10 to 20%, and $ZrO_2$: 5 to 15% with other impurities: at most 1%, and satisfy a formula $17.0(LiF+ZrO_2)-556 \leqq CaF_2 \leqq 4.1(LiF+ZrO_2)-80.9$, with optionally containing $Cr_2O_3$, MnO, $TiO_2$ and MgO: at most 5% in total. The ESR electrode 10 is so positioned that its top end could be immersed in the slag 11. In this embodiment, the ESR furnace 1 is illustrated as opened; but naturally, the invention is applicable also to a closed ESR furnace that requires atmosphere regulation.

Next described is ESR with the slag. When the electric power 2 is turned on to electrify the ESR electrode 10 and the slag 11, then the slag 11 and the top end of the ESR electrode 10 melt owing to the resistance heat of the slag 11. The molten metal dropwise runs down through the slag 11 having a suitable viscosity (at most 1 poise), and during this, S and the like in the molten metal are taken into the slag and the metal is thereby purified and forms a melt pool 12 below the slag, and this is gradually cooled from the furnace wall and the furnace bottom to give an ESR ingot 13. With the formation of the ESR ingot 13 and the melt pool 12, the slag 11 gradually floats and moves upward; and in accordance with this, the ESR electrode 10 is let down and is continuously remelted. As in the above, the molten metal runs down through the slag 11 and is thereby effectively desulfurized, and then this is cooled from the furnace wall and the furnace bottom to give an ingot which has a good casting surface and good internal properties and in which the eutectic compounds are refined.

EXAMPLES

Examples of the invention will be described below.

A slag of the invention containing $CaF_2$: 25%, CaO: 25%, $SiO_2$: 25%, LiF: 15%, $ZrO_2$: 10%, and others: at most 1% in total; and a slag containing $CaF_2$: 70%, LiF: 20%, and $Al_2O_3$: 10%, as shown in Patent Reference 1 (hereinafter this is referred to as an existing slag) were prepared, and their specific resistance and viscosity were measured.

Figure 2:
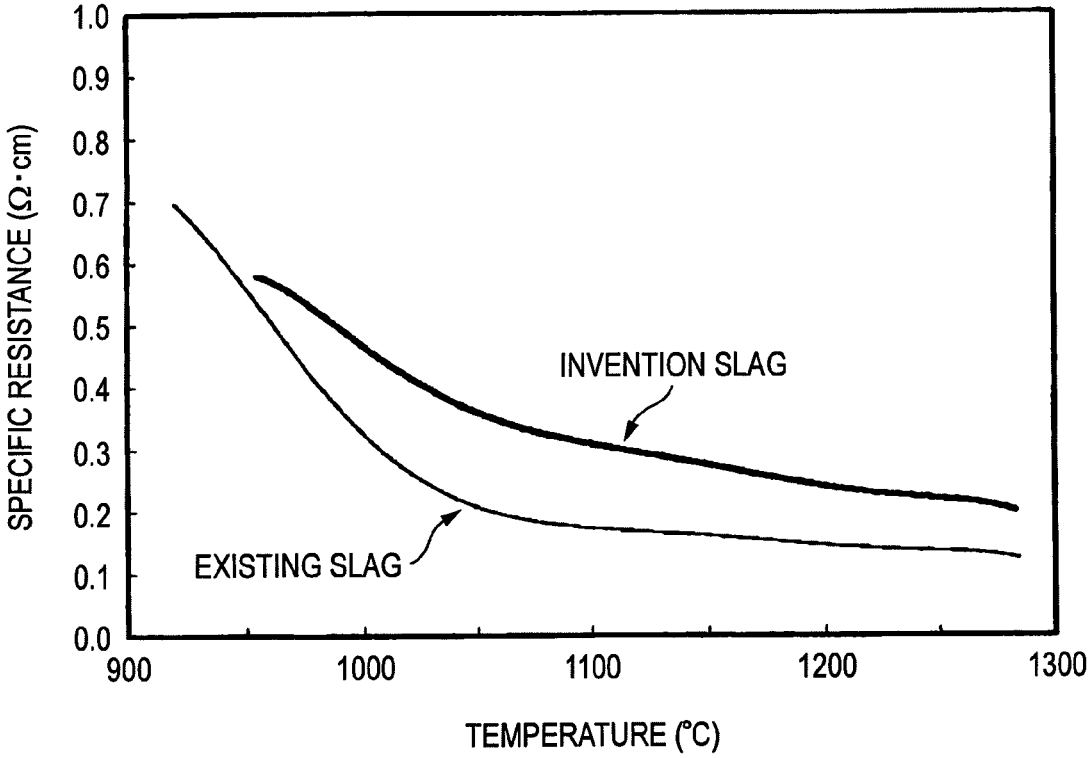
FIG. 2 A graph showing a specific resistance of the invention slag and an existing slag in Example of the invention.

FIG. 2 shows the results of specific resistance measurement. The invention slag has a specific resistance of from 0.1 to 0.7Ω·cm at 1000° C. or higher, as intended.

Figure 3:
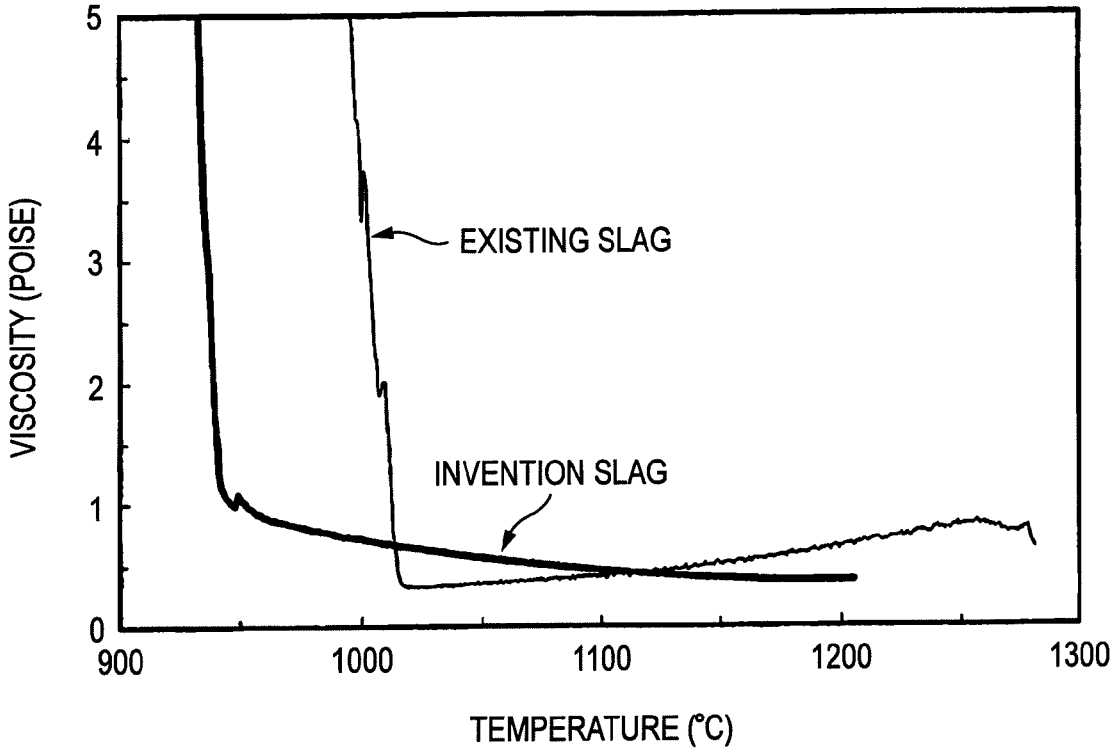
FIG. 3 A graph showing a viscosity of the invention slag and an existing slag in Example of the invention.

FIG. 3 shows the results of viscosity measurement. The invention slag has a viscosity of at most 1 poise at 1000° C. or higher, as intended; however, the existing slag has a high viscosity in the temperature range around 1000° C.

Figure 8:
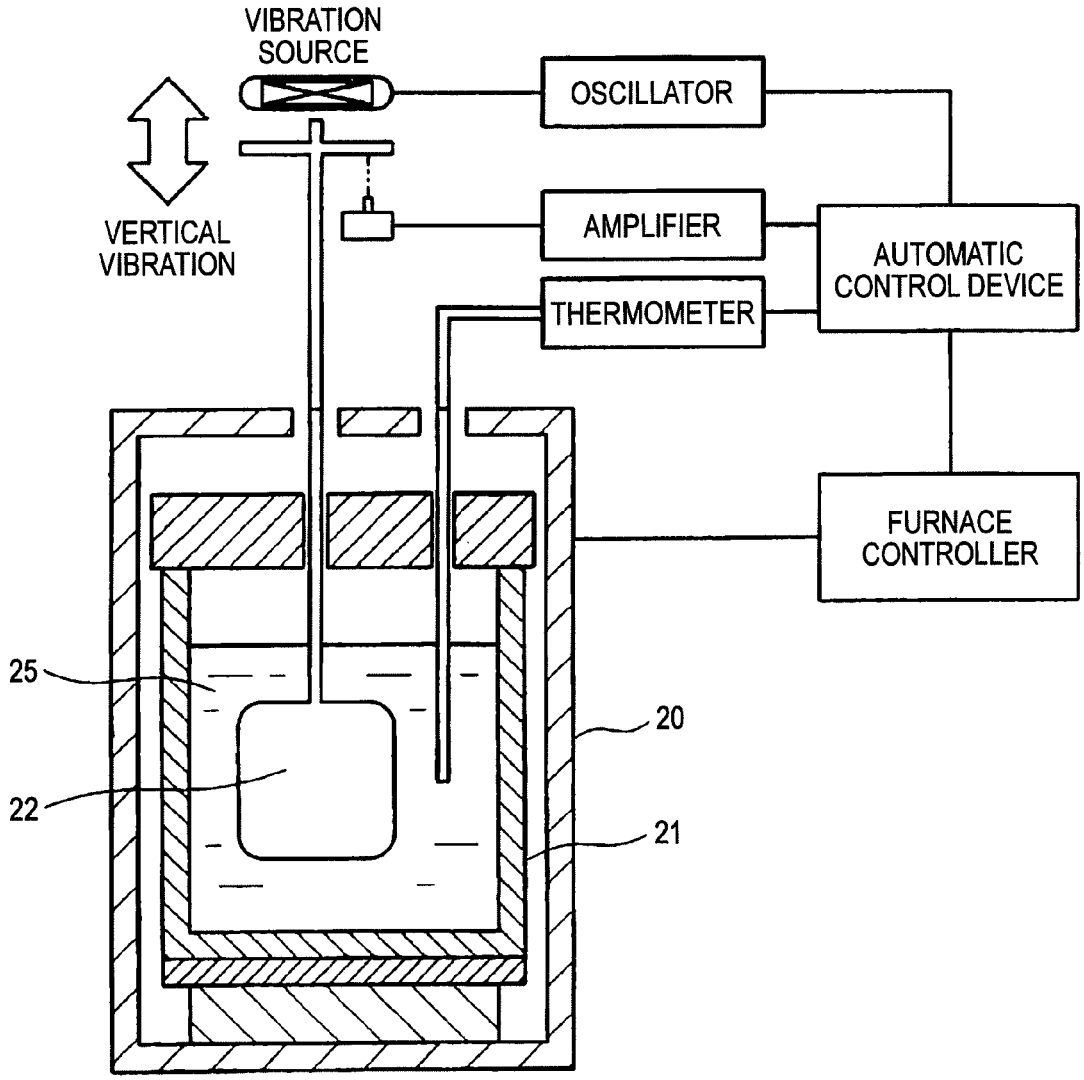
FIG. 8 A view showing a viscosity measuring device used for measuring the viscosity in Example of the invention.

The viscosity was measured according to the method mentioned below. FIG. 8 shows an outline of an oscillating viscometer. In the oscillating viscometer, when a thin vibrating element is put in the solution and is vibrated sinusoidally, then the vibrating element receives the viscous resistance of the liquid. When the vibrating element is kept vibrated under a predetermined drive force, then the amplitude of the vibrating element changes in accordance with the viscosity of the liquid, and therefore the viscosity of the liquid may be determined by measuring the amplitude. In viscosity measurement of the slag, a platinum crucible 21 to keep the slag 25 therein was arranged in the heating furnace 20, and the vibrating element 22 was immersed in the slag 25.

When the vibrating element 22 is vibrated at a resonant frequency, then the product (ρμ) of the density and the viscosity of the liquid is given by the following formula:

[Numerical Formula 1]

$$\rho\mu = K\left(\frac{E_a}{E} - 1\right)^2$$

$$K = \frac{R_M^2}{\pi f_a A^2}$$

ρ: density of the liquid under analysis (kg/m$^3$)

μ: viscosity of the liquid under analysis (poise)

$E_a$: amplitude of oscillation in air (m)

E: amplitude of oscillation in the liquid under analysis (m)

$R_M$: resistance fraction of mechanical impedance intrinsic to the viscometer (N·s/m)

f: resonant frequency in air (l/s)

A: area of both surfaces of the vibration element (m$^2$)

When the structure, the material and the dimension of the vibration system are defined, then K in the numerical formula 1 shall have a constant value. Accordingly, when the value of K is previously determined using a sample of which the viscosity and the density are known, and when $E_a$ and E are measured, then the value of ρμ of the liquid under analysis can be determined. With the given density, the viscosity of the liquid under analysis can be calculated. According to this method, the temperature at which the viscosity of the liquid has rapidly increased can be considered as the melting point of the liquid so far as the liquid is not one separable into two phases, and therefore, the melting point can also be determined at the same time.

Next, the specific resistance was measured according to the method mentioned below.

In case where polar plates having a surface area of A ($cm^2$) are put to face each other via a distance of L (cm) therebetween, then the electric resistance $R_x$ (Ω) is represented by the following numerical formula 2:

$$R_x = R\frac{L}{A} \quad \text{[Numerical Formula 2]}$$

$R$: specific resistance (Ω·cm)

Accordingly, the specific resistance is represented by the following numerical formula 3:

$$R = R_X\frac{A}{L} = R_X \times J \quad \text{[Numerical Formula 3]}$$

Figure 9:
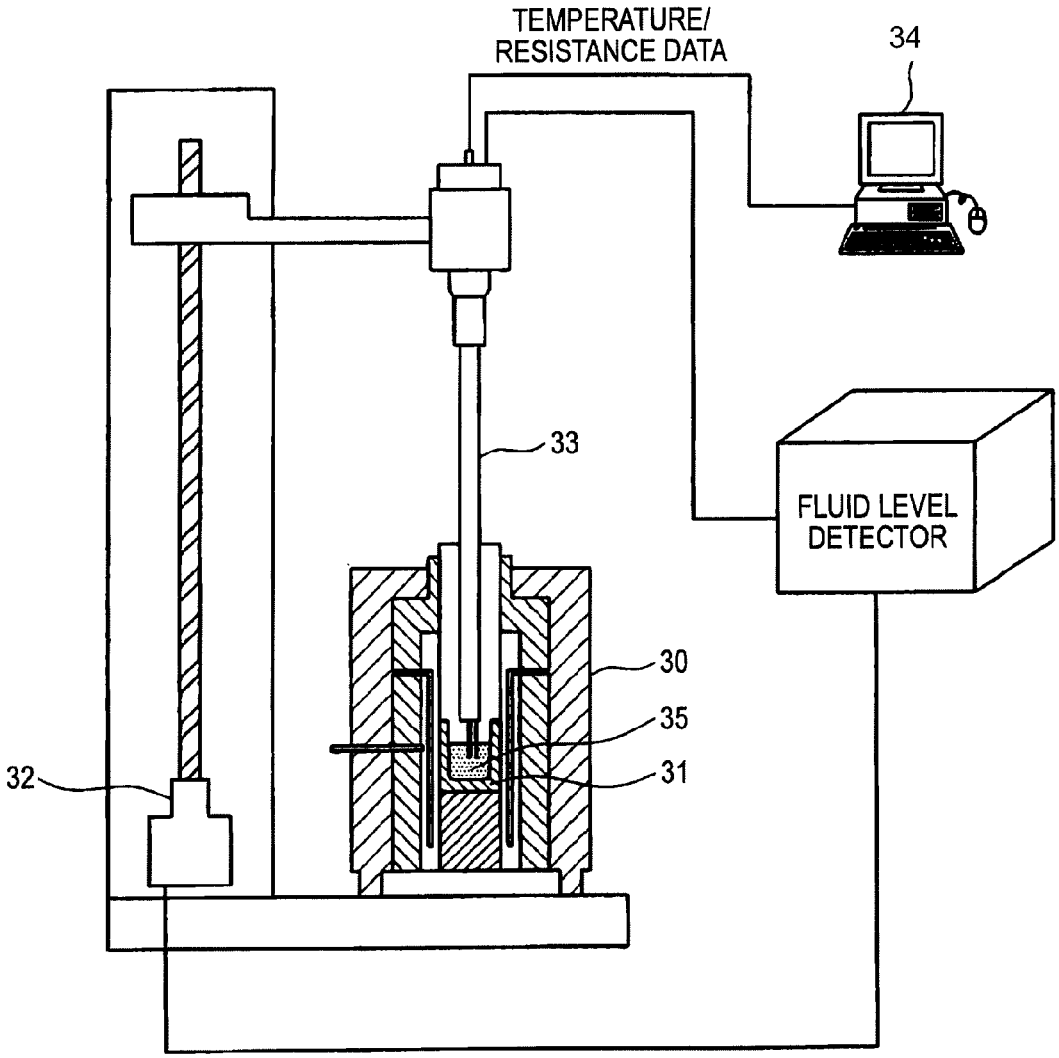
FIG. 9 A view showing a specific resistance measuring device used for measuring the specific resistance in Example of the invention.

The specific resistance is measured in a chamber having a predetermined shape and structure, and the chamber is referred to as a specific resistance cell. FIG. 9 shows an outline of a specific resistance measuring device.

In the specific resistance measuring device, the specific resistance cell 31 is arranged in the furnace body 30, the slag 35 to be analyzed is put in the specific resistance cell 31, and a sensor 33 to measure the temperature and the resistance value of the slag 35 is arranged, as immersed in the slag 35. The sensor 33 is fitted to the sensor elevating and lowering device 32, and based on the detected data of a fluid level detecting device, the sensor 33 is moved up and down by the sensor elevating and lowering device 32 and is placed at a position of a predetermined depth in the slag 35. The detected data by the sensor 33 are transmitted to the personal computer 34 and processed therein, and the specific resistance is thereby determined according to the above-mentioned formula.

J in the above formula (3) is intrinsic to the individual device, and is referred to as a cell constant. The cell constant is determined as follows: The electrode at the sensor tip is immersed in a standard liquid at a predetermined depth from the liquid surface; and R of the standard liquid is divided by the electric resistance $R_x$ thereof measured at room temperature. The cell constant does not depend on temperature, and therefore the value determined at room temperature is applicable also at high temperatures. When the cell constant is determined, then the specific resistance R of the solution under analysis can be determined by measuring the electric resistance Rx of the solution under analysis.

Next, using the invention slag or the existing slag, a ϕ40-mm ESR electrode of an Si-containing copper alloy was melted to give about 5 kg of a ϕ80-mm ESR ingot. The electrode was melted under current control at a target of 700 A with Ar gas kept introduced into the mold. Table 1 shows the results of composition analysis of the ESR electrode and the ESR ingot produced through ESR with the invention slag or the existing slag.

TABLE 1

| Slag Used | | Copper Alloy Composition (% by mass) | | | |
|---|---|---|---|---|---|
| | | Cu | Al | S | Zr |
| Invention Slag | ϕ40 ESR Electrode | bal. | <0.003 | 0.0028 | <0.003 |
| | ϕ80 ESR Ingot | bal. | <0.003 | 0.0018 | 0.008 |
| Existing Slag | ϕ40 ESR Electrode | bal. | <0.003 | 0.0004 | — |
| | ϕ80 ESR Ingot | bal. | 0.020 | 0.0007 | — |

Figure 4:
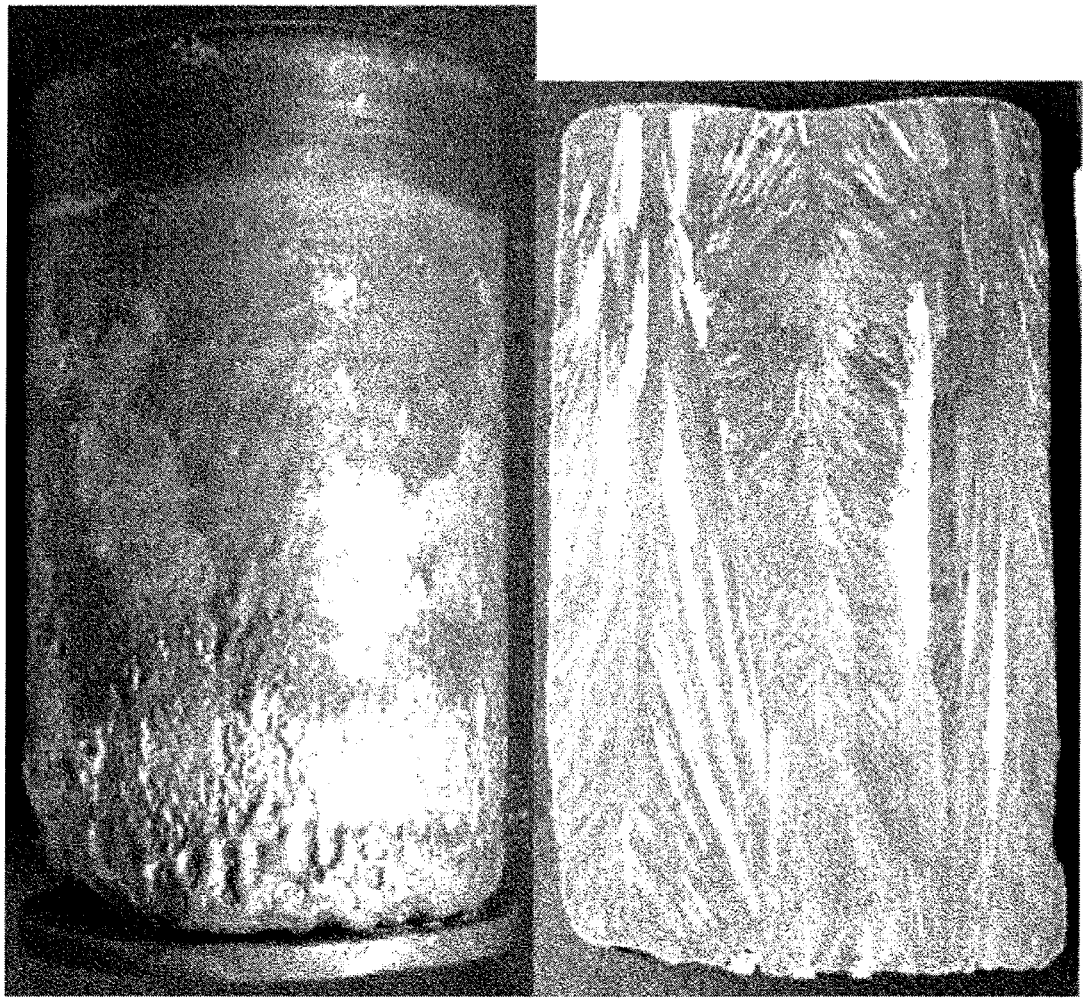
FIG. 4 Drawing-substitute photographs showing (a) a surface and (b) a vertical cross section of an ESR ingot cast with the invention slag in Example of the invention.
Figure 5:
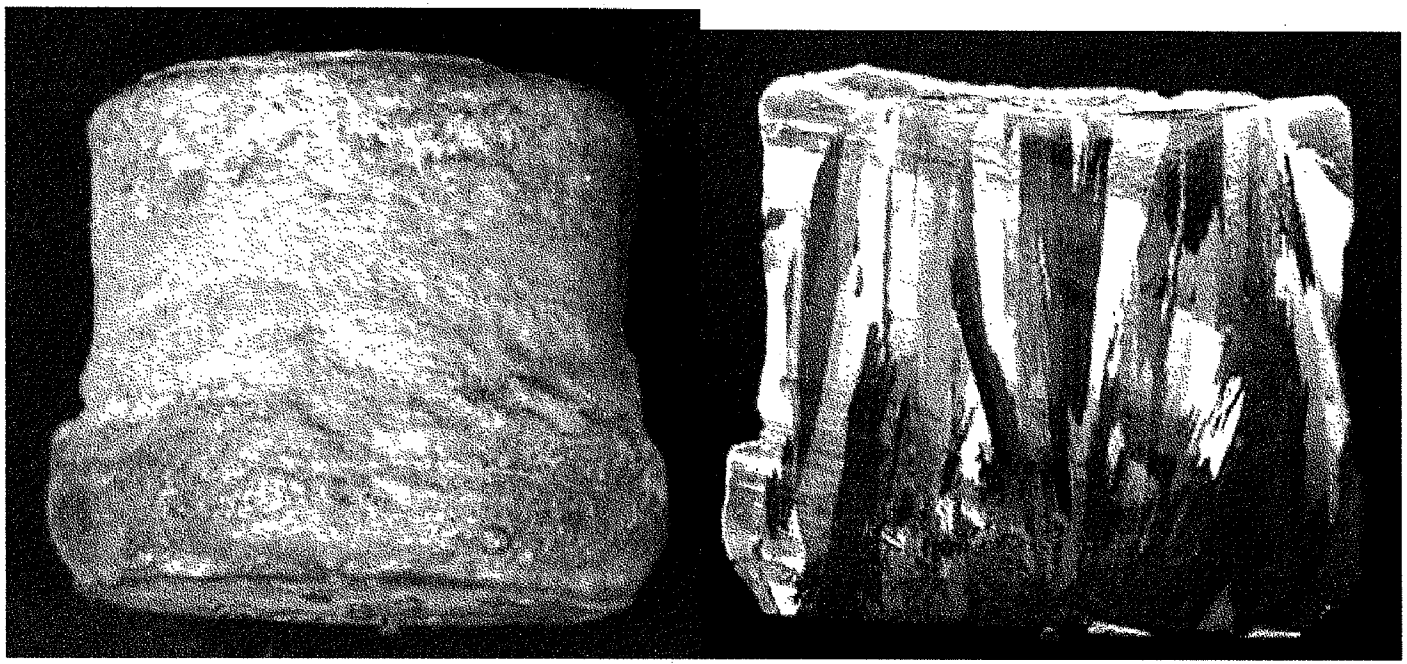
FIG. 5 Drawing-substitute photographs showing (a) the surface and (b) the vertical cross section of the ESR ingot cast with an existing slag in Example of the invention.

FIG. 4 shows the outward appearance of the ingot obtained by ESR with the invention slag, and the macrostructure of the vertical cross section thereof. The obtained ingot has a good casting surface, and no cast defect is seen inside it. FIG. 5 shows the outward appearance of the ingot obtained by ESR with the existing slag, and the macrostructure of the vertical cross section thereof. In ESR with the existing slag, the melting was not stable and stopped owing to overcurrent along the way, and therefore, the ingot was short. Though no cast defect is seen in the ingot, the casting surface is roughened. This is because the specific resistance, the viscosity and the melting point of the slag were not adequately regulated.

As in the results of composition analysis in Table 1, the ingot obtained by ESR with the invention slag was not contaminated with Al and the S content therein was reduced more than in the electrode. In addition, the Zr content was on the level with no influence on properties. On the other hand, the ingot obtained by ESR with the existing slag was contaminated with Al and the S content therein increased somewhat more than in the ESR electrode.

Figure 6:
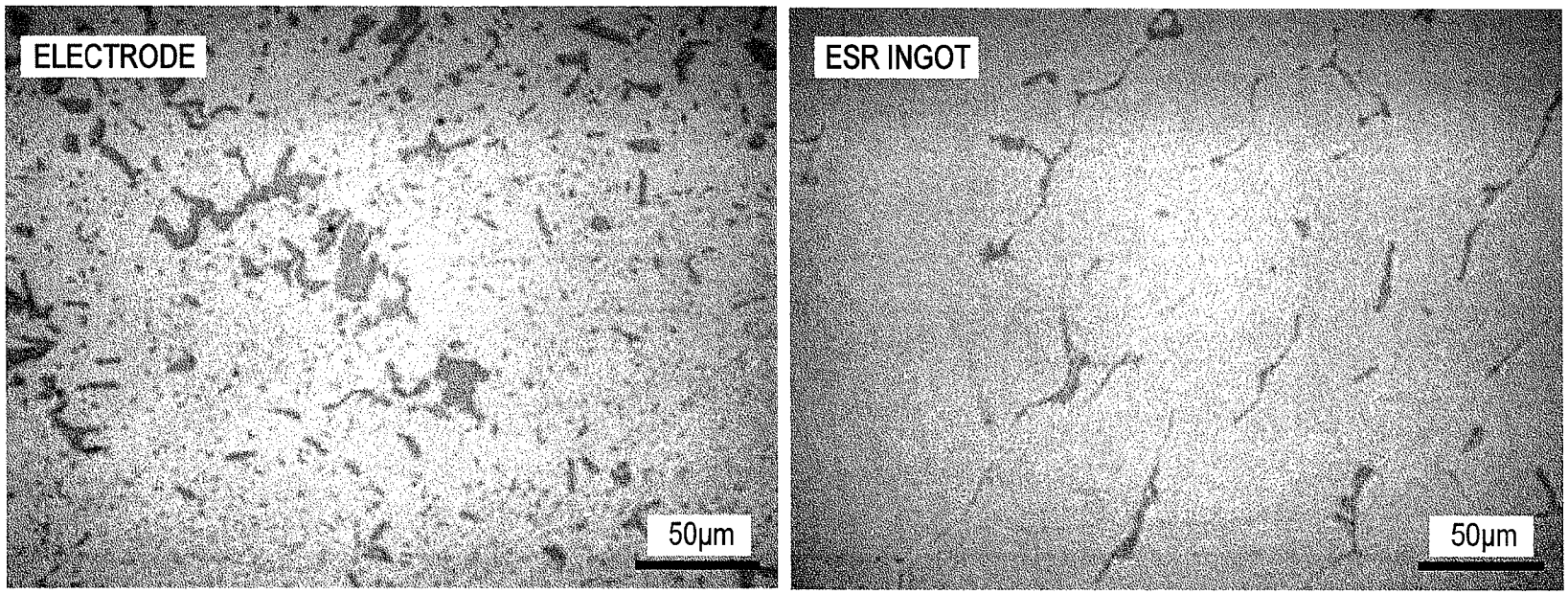
FIG. 6 Drawing-substitute photographs showing microstructure of (a) an ESR electrode and (b) an ESR ingot with the invention slag in Example of the invention.

FIG. 6 shows the microstructure of the ESR electrode and the ingot obtained by ESR with the invention slag. The eutectic compounds in the ingot were refined more than in the electrode.

Next, electroslag remelting slags for copper alloy were prepared, as formulated as in Table 2; and according to the above-mentioned methods, the melting point, the viscosity (poise) and the specific resistance at 1000° C. thereof were measured. The results are shown in Table 2. The data of the constitutive components of the slags are plotted on FIG. 7 along with the scope of the invention drawn therein.

As obvious from Table 2, the slags of the invention had a melting point of not higher than 1000° C., and had good viscosity and specific resistance at 1000° C. In case where $ZrO_2$ is added in an amount of around 10%, a blend ratio of $CaF_2$:CaO:$SiO_2$=1:1:1 is preferred as the slags could readily have a low melting point.

TABLE 2

(wt. %)

| No. | $CaF_2$ | CaO | LiF | $SiO_2$ | $ZrO_2$ | Formula | melting point (° C.) | viscosity (1000° C.) (poise) | specific resistance (1000° C.) (Ω · cm) |
|---|---|---|---|---|---|---|---|---|---|
| 1 | 25.0 | 25.0 | 20.0 | 25.0 | 5.0 | X | 1100 | >1 | * |
| 2 | 23.3 | 23.3 | 20.0 | 23.3 | 10.0 | ○ | 830 | <1 | 0.29 |
| 3 | 21.7 | 21.7 | 20.0 | 21.7 | 15.0 | X | 1040 | >1 | * |
| 4 | 45.0 | 15.0 | 20.0 | 15.0 | 5.0 | X | 1080 | >1 | * |
| 5 | 42.0 | 14.0 | 20.0 | 14.0 | 10.0 | ○ | 920 | <1 | 0.18 |
| 6 | 39.0 | 13.0 | 20.0 | 13.0 | 15.0 | ○ | 900 | <1 | 0.18 |
| 7 | 24.0 | 24.0 | 17.5 | 24.0 | 10.5 | ○ | 830 | <1 | 0.25 |
| 8 | 24.8 | 24.8 | 15.0 | 24.8 | 10.8 | ○ | 950 | <1 | 0.48 |
| 9 | 25.5 | 25.5 | 12.5 | 25.5 | 11.0 | X | 1040 | >1 | * |
| 10 | 22.0 | 22.0 | 22.0 | 22.0 | 12.0 | ○ | 880 | <1 | 0.30 |

Formula: Slags satisfying the formula are represented by "○"; and those not satisfying the formula are by "X".
Specific Resistance: * means that the specific resistance was not measured since the slags were considered unsuitable to ESR slags from the value of the melting point thereof.

In the above Examples, the copper alloys did not contain Cr, Mn, Ti and Mg. In case where the alloy contains at least one of these components, at least one of $Cr_2O_3$, MnO, $TiO_2$ and MgO may be added to the slag in an amount of at most 5% in total. Adding these components to the slag of the invention increases the yield of these components in the ESR ingot not detracting from the effect of the slag of the invention. However, when the total amount is more than 5%, then the slag viscosity increases and stable melting is difficult.

While the invention has been described in detail and with reference to specific embodiments thereof, it will be apparent to one skilled in the art that various changes and modifications can be made therein without departing from the spirit and scope thereof. The present application is based on a Japanese patent application (Application No. 2007-326097) filed Dec. 18, 2007, the contents thereof being hereby incorporated by reference.

INDUSTRIAL APPLICABILITY

Using the slag for electroslag remelting for Si-containing copper alloy of the invention makes it possible to produce a copper alloy material, in which S is reduced with no contamination with Al, which has a good casting surface and good internal properties and in which the eutectic compounds are refined.

The invention claimed is:

1. A slag for electroslag remelting for copper alloy, including $CaF_2$: 20 to 45% by mass, CaO: 10 to 30% by mass, $SiO_2$: 10 to 30% by mass, LiF: 10 to 20% by mass and $ZrO_2$: 5 to 15% by mass with other impurities: at most 1% by mass, and satisfying a following formula:

$$17.0(\text{LiF content}+ZrO_2\text{ content})-556 \leqq CaF_2\text{ content} \leqq 4.1(\text{LiF content}+ZrO_2\text{ content})-80.9.$$

2. The slag for electroslag remelting for copper alloy according to claim 1, further including at least one of $Cr_2O_3$, MnO, $TiO_2$ and MgO: at most 5% by mass in total.

3. The slag for electroslag remelting for copper alloy according to claim 1, wherein the slag has a specific resistance of from 0.1 to 0.7Ω·cm and a viscosity of at most 1 poise at 1000° C. or higher.

4. A method for producing a copper alloy material by electroslag-melting a copper alloy with the slag for electroslag melting for copper alloy according to claim 1.

* * * * *